United States Patent [19]

Baumanis

[11] 3,941,449

[45] Mar. 2, 1976

[54] TERMINAL FOR APERTURED CIRCUIT PANEL

[75] Inventor: Bruno Baumanis, River Forest, Ill.

[73] Assignee: Molex Incorporated, Lisle, Ill.

[22] Filed: Apr. 5, 1974

[21] Appl. No.: 458,070

[52] U.S. Cl. ..... 339/217 S; 339/252 P

[51] Int. Cl.[2] ..... H01R 9/08

[58] Field of Search ..... 339/217 R, 217 S, 17 R, 339/17 C, 252 R, 252 P

[56] References Cited

UNITED STATES PATENTS

| | | | |
|---|---|---|---|
| 2,871,551 | 2/1959 | Harris | 339/17 C X |
| 2,877,441 | 3/1959 | Narozny | 339/217 S X |
| 2,950,458 | 8/1960 | Artz | 339/217 S |
| 3,072,880 | 1/1963 | Olsson | 339/217 S |
| 3,121,602 | 2/1964 | Tuchel | 339/17 C X |
| 3,573,722 | 4/1971 | Delano et al. | 339/252 P X |
| 3,777,303 | 12/1973 | McDonough | 339/217 R X |
| 3,865,459 | 2/1975 | Mills | 339/217 S |

*Primary Examiner*—Joseph H. McGlynn
*Assistant Examiner*—James W. Davie
*Attorney, Agent, or Firm*—Louis A. Hecht

[57] ABSTRACT

A conductive metal terminal serves to secure a wire conductor to a printed circuit board or other circuit panel. The terminal includes a wire engaging portion for crimping to the wire conductor, together with a nose portion for insertion into a hole in the circuit board. The nose portion is generally cylindrical in shape and its leading edge is defined by a plane sloped relative to the cylinder axis in order to provide a bevelled tip facilitating entry of the nose portion into the panel hole. A slot extending axially in the wall of the cylindrical nose portion extends from the bevelled tip to permit axial compression during insertion. Forward and rear stop means are provided for retaining the terminal in the panel hole after insertion, thereby to secure the wire conductor to the panel.

10 Claims, 8 Drawing Figures

FIG. 1
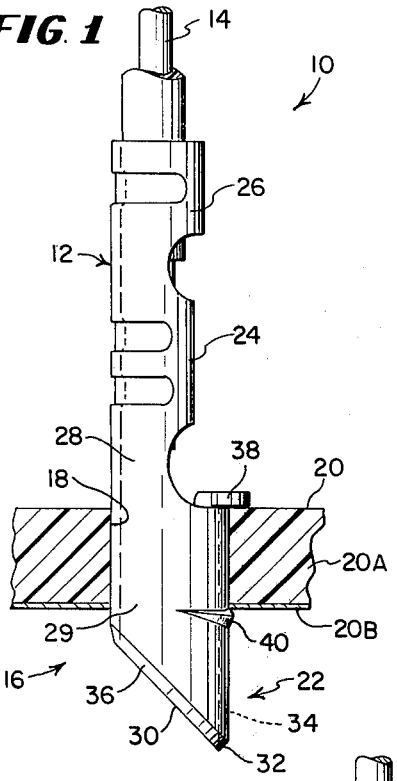
FIG. 2
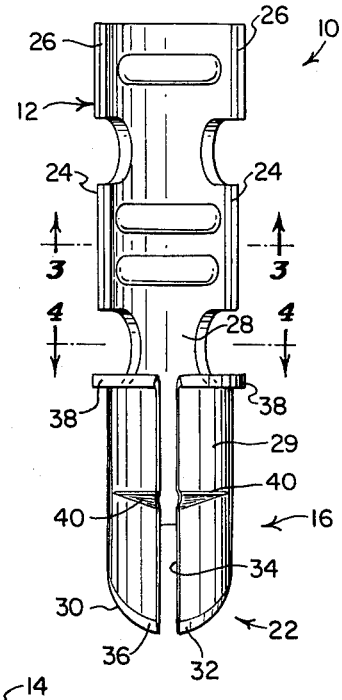
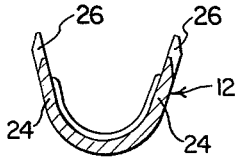
FIG. 3
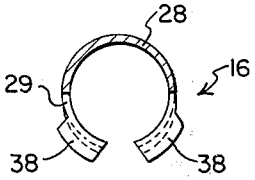
FIG. 4
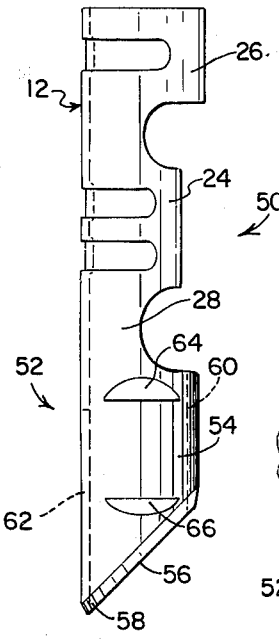
FIG. 5
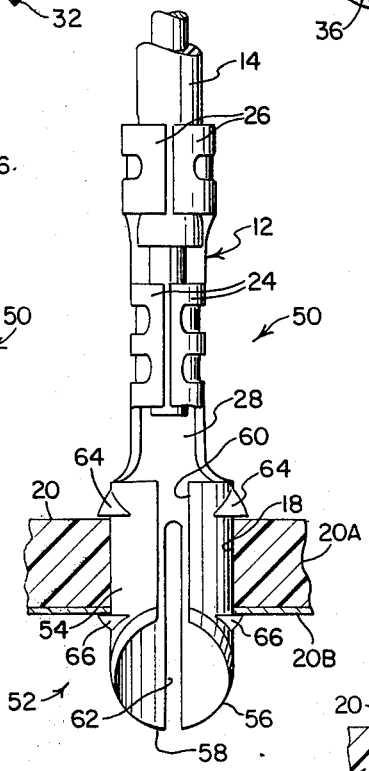
FIG. 6
FIG. 7
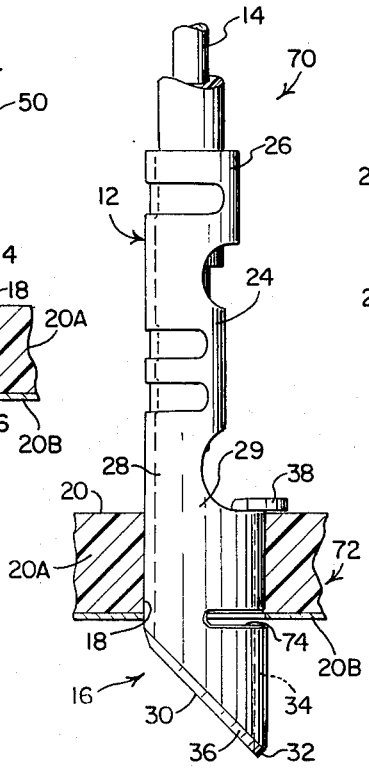
FIG. 8
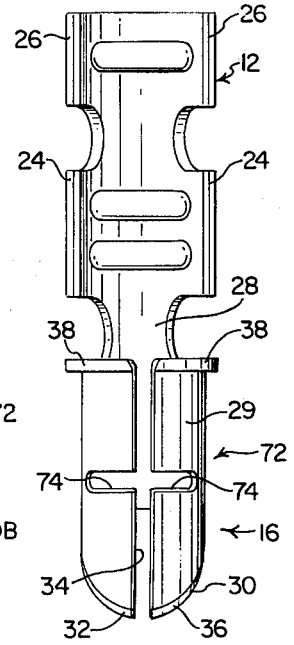

TERMINAL FOR APERTURED CIRCUIT PANEL

The present invention relates to electrical terminals and more particularly to a terminal for securing a conductor to an apertured circuit panel.

In order mechanically to secure and electrically to connect a conductor to a conductive portion of a circuit panel such as a printed circuit board, chassis member or the like, it is possible simply to engage the conductor with the panel and solder the conductor in place. This approach has several disadvantages in modern production techniques. One disadvantage is that the wire must be soldered in place at the time of mounting of the wire, and difficulties may be encountered for example in assembling several wires to a panel prior to a single soldering operation. Another disadvantage is the lack of a firm mechanical connection of the wire to the panel in addition to the solder connection.

As a result of such disadvantages, terminals of various types have been developed for securing a conductor in position on a circuit panel during assembly and for holding the conductor in place until a subsequent soldering operation is performed. Typically, such terminals are fastened to a wire conductor and then are inserted into a preformed hole in the panel. Examples of terminals of this type may be found in the following U.S. Pat. Nos. 3,020,520 — Berg; 3,072,880 — Olsson; and 3,121,602 — Tuchel.

It is an important object of the present invention to provide an improved terminal for securing a conductor to a circuit panel. Other important objects are to provide a terminal capable of accommodating a range of preformed hole sizes; to provide a terminal capable of easily being started in and inserted into a panel hole; to provide a terminal which is insertable without excessive resistance; to provide a terminal wherein deformation or damage to the panel upon insertion is avoided; to provide a terminal which after insertion fits snugly in the panel hole and is reliably retained in place until a subsequent soldering operation; and to provide a terminal overcoming the disadvantages of prior art structures.

Briefly, in accordance with the above and other objects of the invention, there is provided a terminal for use with an apertured circuit panel. The terminal is in the form of a conductive, generally elongated sheet metal body and includes a nose portion adapted to be inserted into the panel aperture together with a conductor engaging portion axially spaced from the nose portion. The nose portion comprises a generally cylindrical segment having a length longer than the panel thickness. The cylindrical nose portion is formed with a cross section complementary to the cross section of the panel aperture. A rear stop structure is provided on the terminal for limiting insertion of the nose portion into the aperture. A forward stop structure is spaced from the rear stop structure by a distance at least as great as the panel thickness and resists withdrawal of the nose portion from the panel aperture after insertion.

In accordance with an important feature of the invention, the leading edge of the nose portion is defined in a plane which is sloped relative to the cylinder axis. Consequently, there is formed a bevelled tip portion of the nose portion facilitating entry of the nose portion into the panel aperture. In order to provide for axial compression of the nose portion upon insertion, a slot in the cylinder wall extends from the leading edge at the bevelled tip in a direction generally parallel to the cylinder axis.

The invention together with the above and other objects and advantages may best be understood with reference to the following detailed description of the embodiments of the invention illustrated in the drawing, wherein:

FIG. 1 is an elevational view of a terminal constructed in accordance with the invention and illustrating the terminal after connection to a conductor and after insertion into a circuit panel hole;

FIG. 2 is a side elevational view of the terminal of FIG. 1 illustrating the terminal prior to connection to a conductor and prior to insertion into a panel hole;

FIG. 3 is a sectional view taken along the line 3—3 of FIG. 2;

FIG. 4 is a sectional view taken along the line 4—4 of FIG. 2;

FIG. 5 is an elevational view of a terminal comprising an alternative embodiment of the invention;

FIG. 6 is a side elevational view of the terminal of FIG. 5 illustrating the terminal after connection to a conductor and after insertion of the terminal into a panel opening;

FIG. 7 is an elevational view of a terminal comprising another alternative embodiment of the invention, illustrating the terminal after connection to a conductor and after insertion into a panel opening; and FIG. 8 is a side elevational view of the terminal of FIG. 7 illustrating the terminal prior to insertion into a panel hole and prior to connection to a conductor.

Having reference now to the drawing, and initially to FIGS. 1–4, there is illustrated a terminal designated as a whole by the reference numeral 10 and constructed in accordance with the principles of the present invention. The terminal 10 is formed of conductive material, such as tin plated brass or the like, and may, for example, be formed from sheet metal by a series of punch press operations. In general, the terminal 10 includes a conductor engaging portion generally designated as 12 serving to fasten the terminal to a conductor 14 as well as a nose portion generally designated as 16 adapted to be inserted into a hole 18 in a circuit panel 20. In accordance with the present invention, the nose portion 16 of the terminal 10 is provided with a novel entry tip structure designated as a whole by the reference numeral 22 and serving to facilitate starting and insertion of the nose portion 16 into the hole 18.

In the embodiments of the invention illustrated in the accompanying drawing, the panel member 20 comprises a printed circuit board including an insulating substrate 20A upon a surface of which there is provided one or more conductive regions 20B in any suitable pattern. In accordance with known practice, the hole 18 may comprise one of several holes preformed in the panel 20 at points where conductors such as the conductor 14 are to be connected. In the illustrated embodiments of the invention, the panel 20 is a one-sixteenth inch board and the hole 18 is of 0.071 inch diameter. It should be understood that the principles of the present invention may be embodied in terminals for securing conductors not only to printed circuit boards but also to other circuit panels such as metal chassis panels and the like.

Although the principles of the invention may be applied to terminals having other types of conductor engaging portions, the portion 12 of the illustrated terminal 10 is intended to be fastened by crimping to a wire conductor. Consequently, the conductor engaging portion 12 includes a pair of wire crimp flanges 24 adapted as illustrated in FIG. 1 to be crimped against the exposed end portion of a conductor wire, as well as a pair of insulation crimp flanges 26 adapted to be crimped against the wire insulation of the conductor.

In overall aspect, the terminal 10 comprises a somewhat cylindrical, elongated, pin-like body. After crimping of the conductor engaging portion 12 to the conductor 14, as best seen in FIG. 1, the terminal 10 is generally in line with the wire and functions as a post or pin-like tip or extension thereof. A connecting portion 28 of the terminal 10 bridges the space between and is in line with the conductor engaging portion 12 and the nose portion 16.

Having reference now more specifically to the structure of the nose portion 16, the nose portion comprises a generally circular cylindrical segment 29 generally complementary in cross section to the hole 18. As can be seen with reference to FIG. 1, the cylindrical segment 29 is longer than the thickness of the circuit panel 20.

After attachment of the conductor engaging portion 12 to the conductor 14, the terminal is inserted into the hole 18. In accordance with an important feature of the invention, the entry tip structure 22 is provided for facilitating this insertion operation. More specifically, the cylindrical segment 29 is provided with a leading edge 30 of novel configuration in that it is defined by a plane sloped relative to the central axis of the cylindrical segment 29. The angle of slope is approximately forty-five degrees. As a result, there is provided a somewhat pointed or sharp bevelled tip 32 capable of easily being started into the panel hole 18.

In order to provide for flexible radial compression of the nose portion upon insertion, the cylindrical segment 29 is provided with an open seam 34 extending throughout its length. The seam 34 extends from the leading edge 30 of the nose portion, and in accordance with a feature of the invention, the seam extends from the bevelled tip 32. Consequently, as the nose portion 16 is started into the hole 18, the slot structure provided by the seam 32 allows resilient flexibility and compressibility. The slanted or bevelled leading edge 30 can engage the wall of the opening 18 and cam the walls of the seam 34 toward one another. This novel arrangement reduces the resistance which might otherwise be encountered during insertion of the nose portion 16 into the hole 18.

In order to avoid the presence of sharp or burred edges at the leading edge 30, preferably the intersection of the leading edge 30 with the exterior surface of the cylindrical segment 29 is coined, as indicated by the reference numeral 36. This coining also cooperates with the novel entry tip structure 22 to reduce insertion forces.

In addition to ease of insertion, another important advantage of the terminal 10 is that the tendency for the terminal to deform the walls of hole 18 or to separate the conductive layer 20B from the substrate 20A of a printed circuit board is minimized. Both due to the coined surface 36 and due to the resilience provided by the combination of the sloped leading edge 30 and the seam 34 extending from the tip 32, the nose portion 16 moves into position without a tendency to push the conductive layer 20A out of position. The bevel of the leading edge 30 also tends to hold the tip 32 away from the wall surface of the hole 18 during insertion until after the tip 32 is well into or through the hole 18.

In order to limit insertion of the terminal 10 to the desired position, there is provided a rear stop structure. In the arrangement of FIGS. 1–4 the rear stop structure is provided by a pair of flange members 38 extending radially outward from the cylindrical nose portion 16. The flange members 38 are preferably formed by outwardly bending portions of the trailing edge of the cylindrical segment. As shown in FIG. 1, the flange members 38 engage the surface of the panel 20 upon full insertion to prevent overinsertion of the terminal.

In order to resist withdrawal of the terminal 10 from the panel 20 after insertion, there is provided a forward stop structure which, in the arrangement of FIGS. 1–4, takes the form of a pair of protuberances 40 formed in the side wall of the cylindrical nose portion 16. The protuberances 40 preferably have somewhat sloped surfaces so that upon insertion, a camming action is provided for resiliently compressing the cylindrical segment 29 as the protuberances are moved through the hole 18. Upon full insertion, expansion of the nose portion 16 within the hole 18 moves the protuberances 40 under the surface of the panel so that withdrawal of the terminal is resisted.

After the terminal 10 is attached to a conductor 14 and inserted into the panel 20, the terminal serves to hold the conductor until a subsequent soldering operation during which the terminal is soldered to the conductive layer 20B. Due to the generally cylindrical nature of the nose portion 16, the terminal is firmly held in place within the hole 18 and there is little tendency for the terminal to wobble and work loose from the hole. Preferably the relaxed outside diameter of the cylindrical segment 29 is somewhat larger than the hole diameter. In the illustrated embodiments, the cylindrical segment has an outer diameter of 0.077 inch. The generally cylindrical configuration of the nose portion 16 and the open seam 34 make it possible for the nose portion radially to contract upon insertion so that a range of preformed hole sizes may be accommodated by a terminal of a single size. Radial expansion of the nose portion against the wall of the hole 18 serves firmly to hold the terminal in place.

Having reference now to FIGS. 5 and 6, there is illustrated a terminal 50 comprising an alternative embodiment of the present invention. In many respects, the terminal 50 is similar to the terminal 10 illustrated in FIGS 1–4 and described above. Similar reference numerals are used in FIGS. 5 and 6 for similar portions of the structure, and the description thereof is not repeated below.

The terminal 50 differs from the terminal 10 in the configuration of its nose portion, designated as a whole by the reference numeral 52. The nose portion 52 comprises a generally circular cylindrical segment 54 complementary in cross section to the hole 18 formed in the circuit panel 20. As can be seen with reference to FIG. 6, the cylindrical segment 54 is longer than the thickness of the circuit panel 20.

After attachment of the conductor engaging portion 12 of the terminal 50 to the conductor 14, the terminal is inserted into the hole 18. In accordance with an important feature of the invention, the cylindrical segment 54 is provided with a leading edge 56 defined by a plane sloped relative to the central axis of the segment 54. As a result, there is provided a somewhat pointed or sharp bevelled tip 58 capable of easily being started into the panel hole 18.

As compared with the terminal 10, the terminal 50 exhibits less resistance to radial compression during insertion into a panel opening. The cylindrical segment 54 is provided with an open seam 60 extending throughout its length. The open seam 60 extends from the leading edge 56 at a point generally opposite to the bevelled tip 58.

In addition to the seam 60, the nose portion 52 is provided with a slot 62 which, in accordance with the present invention, extends from the tip 58 of the leading edge 56. The slot 62 in combination with the bevelled leading edge 58 provides a resilient compressibility as the tip 58 is started into the panel hole 18. Additional compressibility is provided upon insertion by the seam 60 disposed radially opposite the slot 62.

In order to retain the terminal 50 in position after insertion into the hole 18, there is provided a pair of rear stop protuberances 64 and a pair of forward stop protuberances 66 on the wall of the cylindrical segment 54. The protuberances 64 and 66 are disposed in opposed positions along the periphery of the cylindrical segment 54 roughly between the seam 60 and slot 62. As can be seen in FIG. 6, the protuberances 64 and 66 are engageable with the opposite surfaces of the panel 20 after insertion to retain the terminal 50 in position.

Having reference now to FIGS. 7 and 8, there is illustrated a terminal 70 comprising another alternative embodiment of the invention. For the most part, the terminal 70 is identical to the terminal 10 illustrated in FIGS. 1–4 and described above. Identical reference numerals are used for identical elements of structure, the description of which is not repeated.

The terminal 70 differs from the terminal 10 in the configuration of its forward structure, designated in FIGS. 7 and 8 by the reference numeral 72. The forward stop structure 72 comprises a pair of slits 74 extending from the seam 34 in opposite directions around the periphery of the cylindrical segment 29. The relaxed diameter of the cylindrical segment 29 between the slits 74 and the bevelled tip 32 is slightly increased relative to the remainder of the cylindrical segment 29. As a result, and as shown in FIG. 7, after insertion of the terminal 70 into the hole 18, withdrawal of the terminal from the panel 20 is prevented by interference with the end portion of the cylindrical segment 29.

While the invention has been described with reference to details of the illustrated embodiments of the invention, such details are not intended to limit the scope of the invention as defined in the following claims.

I claim:

1. A terminal for use with an apertured circuit panel comprising a conductive generally elongated sheet metal body including a nose portion for insertion into the panel apertured and a conductor engaging portion axially spaced from said nose portion, said nose portion comprising a cylindrical segment having a length in excess of the panel thickness and having a substantially constant circular cross section complementary to the aperture cross section, the part of the nose portion within the aperture when the terminal is inserted having a diameter not less than the diameter of the aperture, rear stop means on said body for limiting insertion of said nose portion into the aperture, forward stop means spaced from said rear stop means by a distance at least as great as the panel thickness for resisting withdrawal of said nose portion from the aperture after insertion, and the leading edge of said nose portion from the aperture after insertion, and the leading edge of said nose portion lying substantially in a plane slope relative to the axis of said cylindrical segment and forming a bevelled tip of said nose portion facilitating entry of said nose portion into the panel aperture.

2. A terminal as claimed in claim 1, slot means in the wall of said cylindrical segment generally parallel to the axis of said cylindrical segment and extending from the leading edge of the nose portion.

3. A terminal as claimed in claim 2, said slot means being disposed at said bevelled tip.

4. A terminal as claimed in claim 3, a seam extending the length of said cylindrical segment, said slot means being defined by said seam.

5. A terminal as claimed in claim 1, the intersection of said leading edge and of the exterior suface of said cylindrical segment being coined to reduce resistance to insertion of the nose portion.

6. A terminal as claimed in claim 1, said rear stop means comprising projection means extending radially outward from the wall of said cylindrical segment.

7. A terminal as claimed in claim 6, said projection means comprising stop flanges formed by bending outward portions of the trailing edge of said cylindrical segment.

8. A terminal as claimed in claim 1, said forward stop means comprising protuberance means extending outwardly from said cylindrical segment.

9. A terminal as claimed in claim 2, said forward stop means comprising slit means extending from said slot means partially around the periphery of said cylindrical section.

10. A terminal as claimed in claim 1, said conductor engaging portion comprising wire crimp structure for crimping to a wire conductor.

* * * * *